US007367325B2

(12) United States Patent
Sakamoto et al.

(10) Patent No.: US 7,367,325 B2
(45) Date of Patent: May 6, 2008

(54) FUEL FEED APPARATUS HAVING ELECTRIC CONNECTOR

(75) Inventors: Yukio Sakamoto, Toyoake (JP); Takashi Akiba, Anjo (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 11/491,017

(22) Filed: Jul. 24, 2006

(65) Prior Publication Data

US 2007/0044772 A1 Mar. 1, 2007

(30) Foreign Application Priority Data

Aug. 26, 2005 (JP) ..... 2005-245384

(51) Int. Cl.
*F02M 37/04* (2006.01)

(52) U.S. Cl. ..... 123/509; 439/680; 439/378

(58) Field of Classification Search ..... 439/156, 439/176, 190, 587, 680, 378; 123/509
See application file for complete search history.

(56) References Cited

U.S. PATENT DOCUMENTS 5,345,124 A * 9/1994 Lang ..... 310/51
5,387,119 A * 2/1995 Wood ..... 439/281
5,522,425 A * 6/1996 Kroiss et al. ..... 137/590
5,704,799 A * 1/1998 Wood ..... 439/281
5,992,394 A * 11/1999 Mukaidani et al. ..... 123/509
6,106,244 A * 8/2000 Nakatsukasa et al. ..... 417/313
6,561,846 B2 * 5/2003 D'Addario ..... 439/540.1
7,086,493 B2 * 8/2006 Knight ..... 180/274
2005/0106928 A1 * 5/2005 Schroder et al. ..... 439/404

FOREIGN PATENT DOCUMENTS

JP 2002-237348 8/2002

* cited by examiner

*Primary Examiner*—Stephen K. Cronin
*Assistant Examiner*—J. Page Hufty
(74) *Attorney, Agent, or Firm*—Nixon & Vanderhye PC

(57) ABSTRACT

A fuel feed apparatus is provided to a fuel tank. The fuel feed apparatus includes a lid member, a pump module, and an electric connector. The lid member plugs an opening of the fuel tank. The pump module is accommodated in the fuel tank for pumping fuel from the fuel tank. The electric connector is provided to the lid member. The electric connector includes at least one terminal and at least one sheath. The at least one terminal electrically connects with the pump module. The at least one sheath covers the at least one terminal partially on a side of the pump module. The at least one sheath has an outer periphery that is surrounded by a recess. The at least one sheath has an end on an opposite side of the pump module. The recess is concaved from the end of the at least one sheath toward the pump module.

8 Claims, 3 Drawing Sheets

FUEL FEED APPARATUS HAVING ELECTRIC CONNECTOR

CROSS REFERENCE TO RELATED APPLICATIONS

This application is based on and incorporates herein by reference Japanese Patent Application No. 2005-245384 filed on Aug. 26, 2005.

FIELD OF THE INVENTION

The present invention relates to a fuel feed apparatus including an electric connector.

BACKGROUND OF THE INVENTION

According to JP-A-2002-237348, a connector for electrically connecting wirings has a structure adapted to restricting terminals from causing a shortcircuit therebetween. In this structure, the terminals are partitioned by a wall member, so that terminals adjacent to each other are restricted from causing a shortcircuit therebetween.

Here, a fuel feed apparatus is provided to a fuel tank for supplying fuel from the fuel tank to an engine outside the fuel tank. In general, when sealing property of a fuel tank provided with a fuel feed apparatus is examined, a submersion test is conducted while the fuel feed apparatus is installed on the fuel tank. In this submersion test, for example, the fuel tank installed with the fuel feed apparatus is submerged under water for examining the sealing property of the fuel tank. The fuel tank has an opening, which is plugged using a lid member of the fuel feed apparatus. The lid member may have an electric connector. When the submersion test is conducted, the electric connector provided to the lid member may be covered with a cap. After conducting the submersion test, air may be blown onto the electric connector to restrict water from remaining in the electric connector.

However, it is difficult to strictly restrict water from remaining in the connector, even providing the cap, and even blowing air onto the electric connector. In addition, when the electric connector is exposed to wind and weather after conducting the submersion test, water may intrude into the electric connector. When the electric connector is attached with a water-proof coupling device while water remains in the electric connector, the remaining water cannot be drained. As a result, terminals in the connector may be corroded. In addition, the terminals may cause a short circuit therebetween.

SUMMARY OF THE INVENTION

In view of the foregoing and other problems, it is an object of the present invention to produce a fuel feed apparatus including an electric connector with a simple structure having water-resistant property.

According to one aspect of the present invention, a fuel feed apparatus is provided to a fuel tank. The fuel feed apparatus includes a lid member that plugs an opening of the fuel tank. The fuel feed apparatus further includes a pump module that is accommodated in the fuel tank for pumping fuel in the fuel tank to outside of the fuel tank. The fuel feed apparatus further includes an electric connector that is provided to the lid member. The electric connector includes at least one terminal and at least one sheath. The at least one terminal electrically connects with the pump module. The at least one sheath covers the at least one terminal partially on a side of the pump module. The at least one sheath has an outer periphery that is surrounded by a recess. The at least one sheath has an end on an opposite side of the pump module. The recess extends from the upper end of the at least one sheath downward toward the pump module.

Alternatively, a fuel feed apparatus is provided to a fuel tank. The fuel feed apparatus includes a lid member that plugs an opening of the fuel tank. The fuel feed apparatus further includes a pump module that is accommodated in the fuel tank for pumping fuel in the fuel tank to outside of the fuel tank. The fuel feed apparatus further includes an electric connector that is provided to the lid member. The electric connector includes a terminal, a sheath, and an outer wall. The terminal electrically connects with the pump module. The sheath covers the terminal partially on a side of the pump module. The sheath extends toward an opposite side of the pump module. The outer wall extends toward the opposite side of the pump module. The outer wall and the sheath define a recess therebetween. The outer wall surrounds the sheath via the recess.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

First Embodiment

Figure 1:
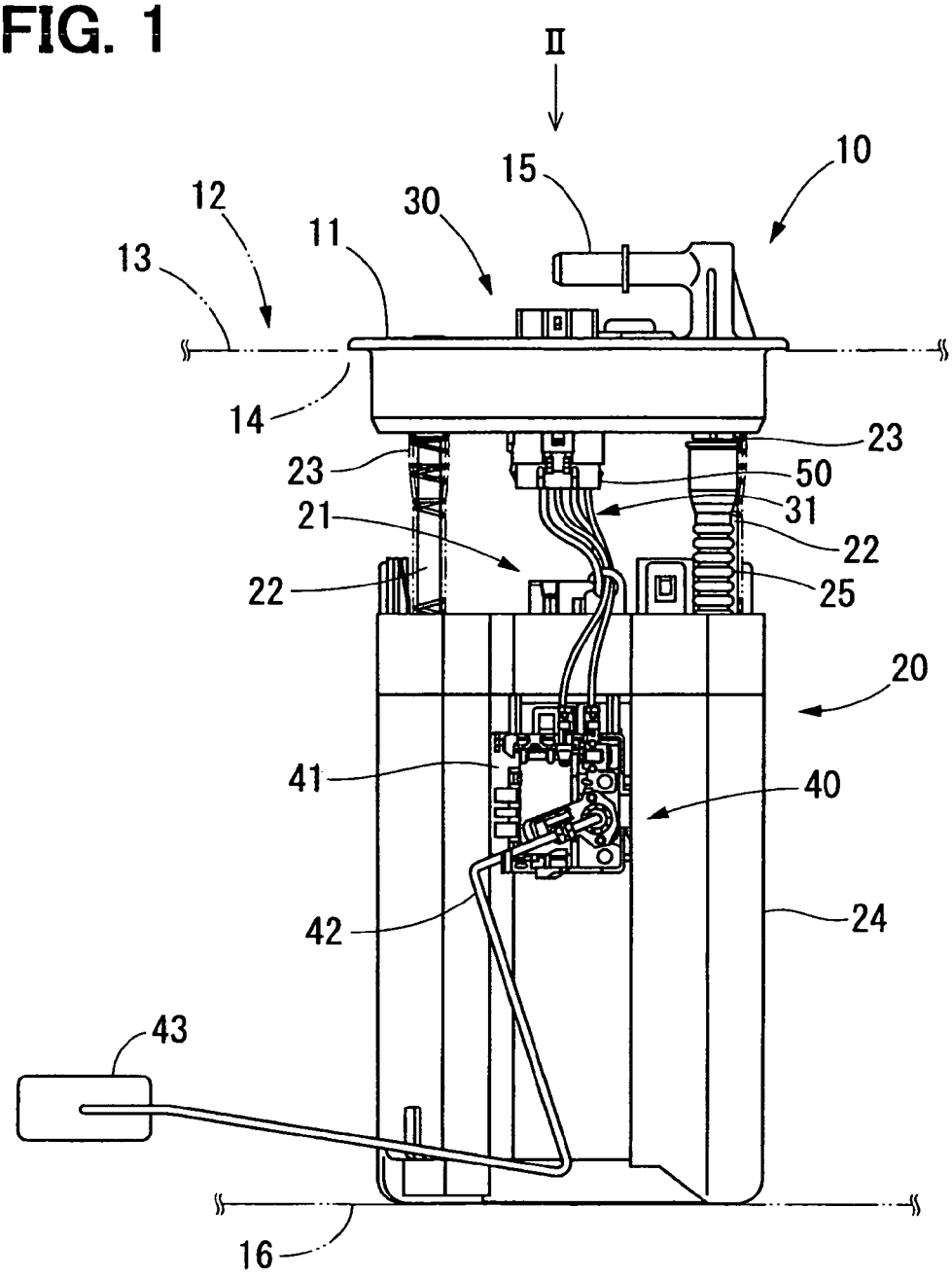

As shown in FIG. 1, a fuel feed apparatus 10 has a flange 11 serving as a lid member. The flange 11 is formed of resin to be in a substantially disc-shape, for example. The flange 11 is provided to an opening 14 formed in an upper wall 13 of a fuel tank 12. The flange 11 plugs the opening 14 in an installation work of the fuel feed apparatus 10 on the fuel tank 12. Components of the fuel feed apparatus 10 excluding the flange 11 are accommodated in the fuel tank 12. The fuel tank 12 is formed of resin, for example. The fuel feed apparatus 10 includes the flange 11 and a sub-tank 20. The flange 11 is attached to the fuel tank 12. The sub-tank 20 is accommodated in the fuel tank 12, as being supported by the flange 11. The sub-tank 20 accommodates the pump module 21.

The flange 11 includes an outlet pipe 15 and an electric connector 30. Fuel is discharged from a fuel pump (not shown) of the pump module 21. The outlet pipe 15 introduces the fuel discharged from the fuel pump to the outside of the fuel tank 12. The electric connector 30 connects with an electric power source and an electronic control unit (ECU: not shown). The electric connector 30 protrudes toward the sub-tank 20 through the flange 11. Lead wires 31 extend from the electric connector 30 into the fuel tank 12 through a coupler 50, which connects with the electric connector 30. The electric power source supplies electric power to the unillustrated fuel pump through the lead wires 31.

The flange 11 connects with the sub-tank 20 via a shaft 22, which serves as a supporting member. The shaft 22 is press-inserted into the flange 11 at one end, and is supported by the sub-tank 20 at the other end. The other end of the shaft 22 on the side of the sub-tank 20 is supported with respect to the sub-tank 20. The sub-tank 20 supports the shaft 22 such that the shaft 22 is axially movable with respect to the sub-tank 20. A spring 23 is provided around the outer periphery of the shaft 22. The spring 23 serves as a bias member. The spring 23 biases the flange 11 and the sub-tank 20 such that the flange 11 and the sub-tank 20 are spaced from each other. Thus, the flange 11 and the sub-tank 20, which accommodates the pump module 21, are movable relatively to each other substantially in the axial direction of the flange 11, i.e. in a vertical direction in FIG. 1. Consequently, the distance between the flange 11 and the sub-tank 20 is adjustable, so that the height of the fuel feed apparatus 10 can the adjusted. In this structure, the sub-tank 20 is regularly pressed onto a bottom wall 16 of the fuel tank 12 by bias force of the spring 23, even when the fuel tank 12 expands or shrinks due to variation in pressure in the fuel tank 12 caused by change in temperature and variation in an amount of fuel received in the fuel tank 12.

The sub-tank 20 has a sidewall 24. The outer periphery of the sidewall 24 is provided with a sender gauge 40. The sender gauge 40 is constructed of a detector 41, an arm 42, and a float 43. The sender gauge 40 detects the amount of fuel received in the fuel tank 12. The float 43 floats around the liquid surface, i.e., liquid level of fuel received in the fuel tank 12. The float 43 moves corresponding to the liquid level of fuel. The arm 42 supports the float 43 rotatably around the detector 41. The detector 41 has various electric wirings each having resistance different from each other. In this structure, the arm 42 supporting the float 43 rotates around the detector 41, as the float 43 moves corresponding to the liquid level of fuel. As the arm 42 rotates, a state of contact between the arm 42 and the detector 41 changes. Consequently, the resistance of the detector 41 changes corresponding to the liquid level of fuel. Thus, the liquid level of fuel is detected in accordance with the resistance of the detector 41. The detector 41 connects with the electric connector 30 via the lead wires 31. The sender gauge 40 detects the liquid level of fuel, and transmits the liquid level to an external device such as the ECU via the lead wires 31 and the electric connector 30.

The sub-tank 20 accommodates the pump module 21. The pump module 21 is constructed of the fuel pump, a fuel filter, a pressure regulator (not shown), and the like.

The fuel pump is driven using a motor (not shown), so that the fuel pump pressurizes fuel and discharges the pressurized fuel to the fuel filter. The fuel filter removes foreign matters contained in the discharged fuel. The pressure regulator controls pressure of the discharged fuel at predetermined pressure. The pressure regulator discharges the pressure-controlled fuel into the outlet pipe 15, provided to the flange 11, through the fuel pipe 25.

Next, the electric connector 30 is described in detail.

Figure 2:
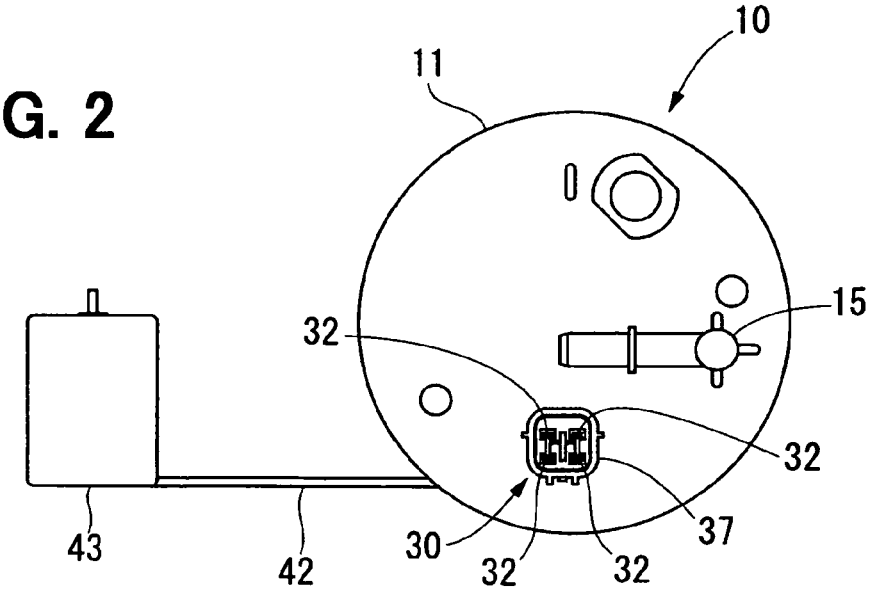
Figure 3A:
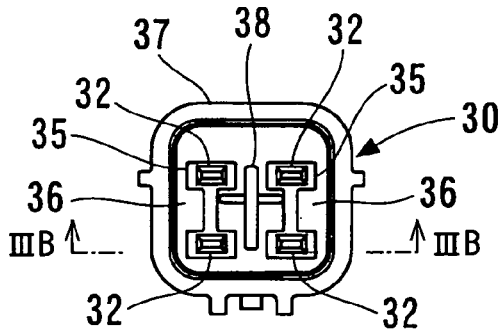
FIG. 3A is a top view showing an electric connector of the fuel feed apparatus.
Figure 3B:
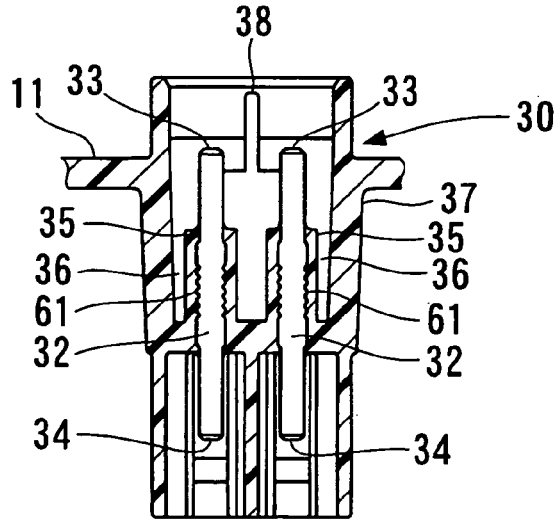
FIG. 3B is a longitudinal sectional view taken along the line IIIB-IIIB in FIG. 3A.

As shown in FIG. 2, the electric connector 30 is provided to the flange 11. The electric connector 30 is integrally formed of resin with the flange 11. As shown in FIGS. 3A, 3B, the electric connector 30 includes terminals 32. The terminals 32 are formed of conductive metal such as copper and aluminum. The terminals 32 penetrate the flange 11. In this structure, one end 33 of each of the terminals 32 is exposed from the flange 11 to the outside of the fuel tank 12. The other end 34 of each of the terminals 32 is exposed from the flange 11 into the fuel tank 12.

The electric connector 30 is provided with a coupling device (not shown). The coupling device is attached to the electric connector 30 from the outside of the fuel tank 12, for example. The coupling device connects with the electric power source and the ECU at the end on the opposite side of the electric connector 30. The coupling device is connected to the electric connector 30, so that each of the terminals 32 electrically connects with a conductive member of the coupling device.

As referred to FIG. 1, the coupler 50 is connected to the electric connector 30 from the inside of the fuel tank 12. The lead wires 31 are electrically connected with the terminals 32 by connecting the coupler 50 with the electric connector 30. The end of the lead wires 31 on the opposite side of the electric connector 30 connects to the unillustrated fuel pump of the pump module 21 and the sender gauge 40.

As referred to FIGS. 3A, 3B, each of the terminals 32 has an axial length covered with a sheath 35. Each sheath 35 is integrally formed of resin with the flange 11, for example. The electric connector 30 has a recess 36 around each sheath 35. The recess 36 is defined between an outer wall 37 of the electric connector 30 and each sheath 35. The recess 36 extends downwardly from the upper end of each sheath 35 on the opposite side of the sub-tank 20 toward the pump module 21, i.e., toward the sub-tank 20. In this structure, the recess 36 surrounds the outer peripheries of the sheath 35. Specifically, each sheath 35 extends from the bottom of each sheath 35 toward the opposite side of the sub-tank 20 in the electric connector 30. The terminals 32 are exposed from the sheaths 35 on the opposite side of the sub-tank 20. In this structure, the recess 36 is defined between the outer wall 37 of the electric connector 30 and the sheaths 35.

The electric connector 30 includes a partition (inner wall) 38 that compartmentalizes the terminals 32 in the electric connector 30. The partition 38 connects with the sheaths 35 at one end, so that the partition 38 divides the interior of the electric connector 30 into multiple regions. In this structure, the partition 38 is located between the terminals 32 in the electric connector 30. Thus, the terminals 32 adjacent to each other can be restricted from causing a short circuit therebetween. The partition 38 is integrally formed of resin with the flange 11 and the electric connector 30, for example. The partition 38 supports the terminals 32, which protrude into the interior of the electric connector 30, together with the sheaths 35. In this structure, the terminals 32 and the sheaths 35 can be restricted from being inclined.

The terminals 32 are insert-molded in the electric connector 30 integrally with the flange 11, for example. That is, the terminals 32 are insert-molded as inserted members when the electric connector 30 and the flange 11 are molded. In this structure, the flange 11 can be readily formed with the electric connector 30, while a manufacturing work is restricted from being increased. Each of the terminals 32 has a ripple-shaped portion 61 at least partially midway through the axial direction of each terminal 32. The ripple-shaped portion 61 serves to enlarge the contact area between each terminal 32 and resin thus firmly affixed to the electric connector 30. In this structure, bonding force between each terminal 32, which serves as the inserted member, and resin, which is formed to be the flange 11 and the electric connector 30, can be enhanced.

The recess 36 is formed around the outer periphery of each sheath 35 of each terminal 32, so that moisture and water intruding and remaining in the electric connector 30 can be accumulated in the recess 36. In this embodiment, the fuel feed apparatus 10 is installed in the fuel tank 12 such that the flange 11 is located on the upper side with respect to the direction of gravitational force. Therefore, moisture and water intruding and remaining in the electric connector 30 can be restricted from accumulating in the vicinity of the terminals 32 protruding from the sheaths 35, so that moisture and water may drop toward the recess 36 by gravitational force. Thus, the terminals 32 protruding from the sheaths 35 can be free from adhered moisture and water. Consequently, the terminals 32 can be free from being corroded due to moisture and water intruding into and accumulating in the electric connector 30. In addition, the terminals 32 can avoid a short circuit therebetween caused by moisture and water adhering to terminals 32. Thus, the water-resisting property of the electric connector 30 can be enhanced.

The recess 36 is formed around the outer periphery of the sheaths 35, so that the wall thickness of the electric connector 30 can be substantially uniform from the end of the electric connector 30 on the opposite side of the sub-tank 20 to the side of the sub-tank 20. Therefore, the flange 11 and the electric connector 30 can avoid causing a recession, i.e., sink, after being formed of resin. Thus, the flange 11 and the electric connector 30 can be maintained in dimension through the forming process of the flange 11 and the electric connector 30, so that dimensional accuracy of the flange 11 and the electric connector 30 can be enhanced.

In this embodiment, the recess 36 is formed around the outer periphery of the sheaths 35 partially with respect to the axial direction of the terminals 32. The unillustrated coupling device connects with the electric connector 30 on the outside of the fuel tank 12 such that the unillustrated coupling device engages with the electric connector 30 on the opposite side of the sub-tank 20 with respect to the sheaths 35. Therefore, even though the recess 36 is formed around the outer periphery of sheaths 35, the recess 36 may not influence the connection between electric connector 30 and the coupling device 100. In this structure, locations of terminals 32 need not be changed, even though the recess 36 is formed. In addition, the sectional shape of the electric connector 30 need not be changed. Therefore, a conventional coupling device may be applied to the fuel feed apparatus 10, even though the recess 36 is formed, so that compatibility can be maintained.

In this embodiment, the recess 36 is formed around the outer periphery of the sheaths 35 partially with respect to the axial direction of the terminals 32. The unillustrated coupling device connects with the electric connector 30 on the outside of the fuel tank 12 such that the unillustrated coupling device engages with the electric connector 30 on the opposite side of the sub-tank 20 with respect to the sheaths 35. Therefore, even though the recess 36 is formed around the outer periphery of sheaths 35, the recess 36 may not influence the connection between electric connector 30 and the coupling device. In this structure, locations of terminals 32 need not be changed, even though the recess 36 is formed. In addition, the sectional shape of the electric connector 30 need not be changed. Therefore, a conventional coupling device may be applied to the fuel feed apparatus 10, even though the recess 36 is formed, so that compatibility can be maintained.

Modified Embodiment

Figure 4A:
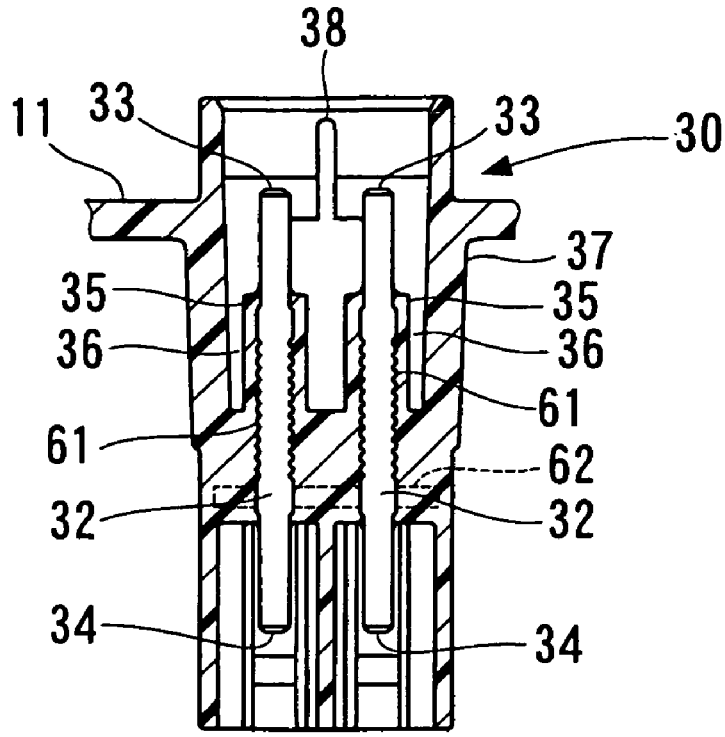
FIG. 4A is a longitudinal sectional view showing an electric connector.
Figure 4B:
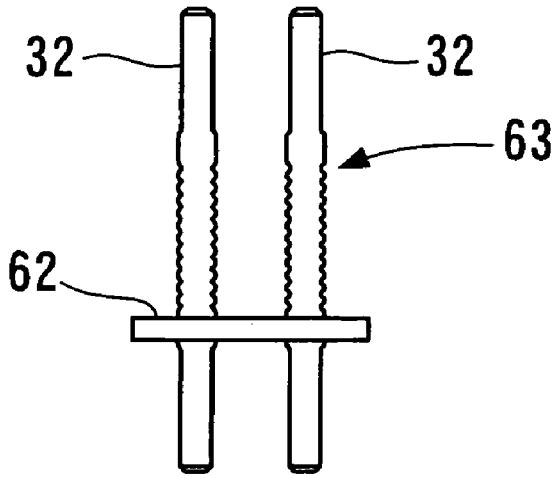
FIG. 4B is a longitudinal view showing a sub-assembly of the electric connector, according to a modified embodiment.

This modified embodiment is described in reference to FIGS. 4A, 4B. In the above embodiment, the terminals 32 are inserted in the electric connector 30 by insert-forming together with the flange 11. By contrast, as shown in FIGS. 4A, 4B, a sub-assembly 63 may be constructed of the terminals 32 and a resinous member (connecting member) 62 such that the terminals 32 are supported by the resinous member 62. The sub-assembly 63 may be insert-formed together with the flange 11 and the electric connector 30, as an inserted member. In this structure, the resin formed to be the resinous member 62 may be the same as the resin formed to be the flange 11 and the electric connector 30. Thus, in this structure, when resin is charged to form the flange 11 and the electric connector 30, the resinous member 62 of the sub-assembly 63 melts, so that the resinous member 62 is joined with the electric connector 30. Consequently, bonding force can be enhanced between the sub-assembly 63 and the resin formed to be the flange 11 and the electric connector 30.

The above structures of the embodiments can be combined as appropriate.

Various modifications and alternations may be diversely made to the above embodiments without departing from the spirit of the present invention.

What is claimed is:

1. A fuel feed apparatus provided to a fuel tank, the fuel feed apparatus comprising:

a lid member that plugs an opening of the fuel tank;

a pump module that is accommodated in the fuel tank for pumping fuel in the fuel tank to an outside of the fuel tank; and an electric connector that is provided to the lid member, wherein the electric connector includes a plurality of terminals each electrically connecting with the pump module, the terminals being located outside the fuel tank with respect to the lid member, the electric connector includes a plurality of sheaths, each partially covering a respective terminal on a side of the pump module, and each sheath having an outer periphery that is substantially surrounded by a recess, and wherein at least two adjacent sheaths are spaced apart by said recess, each sheath has an end on an opposite side of the pump module, the recess extends from the end of each sheath toward the pump module, and the recess is adapted to accumulate moisture that intrudes into the electric connector from an outside of the fuel tank, the electric connector includes an inner wall that compartments the electric connector, and two of the plurality of terminals interpose the inner wall therebetween, the inner wall is integrally formed with the plurality of sheaths, and the inner wall and the plurality of sheaths support the plurality of terminals.

2. The fuel feed apparatus according to claim 1, wherein the plurality of sheaths is formed of resin integrally with the lid member.

3. The fuel feed apparatus according to claim 1, wherein the electric connector has an outer wall that surrounds the plurality of sheaths, and the outer wall and the plurality of sheaths define the recess therebetween.

4. The fuel feed apparatus according to claim 3, wherein the outer wall has a thickness that is substantially uniform.

5. The fuel feed apparatus according to claim 1, wherein each of the plurality of terminals has a ripple-shaped portion at least partially midway through an axial direction of each terminal, the ripple-shaped portion is at least partially covered with the respective sheath, and the ripple-shaped portion has an outer periphery defining a plurality of grooves.

6. The fuel feed apparatus according to claim 1, wherein the electric connector includes a sub-assembly that includes the plurality of terminals, the plurality of sheaths, and a connecting member, the connecting member connects one of the plurality of terminals with an other of the plurality of terminals, and the sub-assembly is at least partially embedded in the electric connector.

7. The fuel feed apparatus according to claim 1, wherein the lid member is located on an upper side of the pump module with respect to a direction of gravitational force, and the plurality of terminals respectively protrudes from the plurality of sheaths upward with respect to the direction of gravitational force.

8. A fuel feed apparatus provided to a fuel tank, the fuel feed apparatus comprising:

a lid member that plugs an opening of the fuel tank;

a pump module that is accommodated in the fuel tank for pumping fuel in the fuel tank to an outside of the fuel tank; and an electric connector that is provided to the lid member, wherein the electric connector includes a plurality of terminals, a plurality of sheaths, and an outer wall, the terminals electrically connect with the pump module, the terminals being located outside the fuel tank with respect to the lid member, each sheath partially covers a respective one of the plurality of terminals on a side of the pump module, the sheaths extend toward an opposite side of the pump module, the outer wall extends toward the opposite side of the pump module, at least two adjacent sheaths define a recess therebetween, the outer wall surrounds the plurality of sheaths and the recess is further defined between the outer wall and the plurality of sheaths, and the recess is adapted to accumulate moisture that intrudes into the electric connector from an outside of the fuel tank, the electric connector includes an inner wall that compartments the electric connector, and two of the plurality of terminals interpose the inner wall therebetween, the inner wall is integrally formed with the plurality of sheaths, and the inner wall and the plurality of sheaths support the plurality of terminals.

* * * * *